US005254320A

United States Patent [19]

Malmström

[11] Patent Number: 5,254,320

[45] Date of Patent: Oct. 19, 1993

[54] METHOD FOR ROASTING SULPHIDE ORES

[75] Inventor: Rolf E. Malmström, Helsinki, Finland

[73] Assignee: A. Ahlstrom Corporation, Noormarkku, Finland

[21] Appl. No.: 808,720

[22] Filed: Dec. 17, 1991

[30] Foreign Application Priority Data

Dec. 17, 1990 [FI] Finland ..... 906201

[51] Int. Cl.[5] ..... C01G 7/00; C01G 5/00; C01G 3/12; C01G 1/12

[52] U.S. Cl. ..... 423/28; 423/23; 423/29; 423/47; 423/561.1

[58] Field of Search ..... 423/23, 27, 28, 29, 423/34, 47, 561.1; 75/643, 733, 736, 737, 718, 729

[56] References Cited

U.S. PATENT DOCUMENTS

| | | | |
|---|---|---|---|
| 1,377,012 | 5/1921 | Howard | 423/47 |
| 2,650,159 | 8/1953 | Tarr, Jr. et al. | 423/47 |
| 4,615,729 | 10/1986 | Victorovich et al. | 75/643 |
| 4,670,228 | 6/1987 | Braaten | 423/21.1 |
| 4,872,423 | 10/1989 | Pillai | 122/40 |
| 5,013,355 | 5/1991 | Elvander et al. | 75/23 |
| 5,074,909 | 12/1991 | Agar | 75/422 |

FOREIGN PATENT DOCUMENTS

| | | |
|---|---|---|
| 208205 | 12/1955 | Australia . |
| 539882 | 4/1957 | Canada . |
| 435479 | 12/1990 | European Pat. Off. . |
| 3303097 | 9/1983 | Fed. Rep. of Germany . |
| 3814127 | 11/1989 | Fed. Rep. of Germany . |
| 677050 | 8/1952 | United Kingdom . |

*Primary Examiner*—David Brunsman
*Attorney, Agent, or Firm*—Nixon & Vanderhye

[57] ABSTRACT

A method for roasting sulphide ores or ore concentrates containing precious metals is practiced in a furnace, typically in a fluidized bed. The ore and a sulphur-binding lime-containing material are supplied to a roasting furnace in which the ore is roasted with the emission of heat and sulphur dioxide. The lime-containing material—such as calcium hydroxide—is mixed into the cooling water for the roasting furnace and sprayed into the furnace as a lime-containing aqueous slurry. Roasting occurs at about 600–850° C. (e.g. 650–750° C.).

Roasted material is discharged from the furnace and acted upon to recover gold, silver and copper metal.

20 Claims, No Drawings

METHOD FOR ROASTING SULPHIDE ORES

BACKGROUND AND SUMMARY OF THE INVENTION

The present invention relates to a method for roasting sulphide ores or concentrated ore products containing precious metals, such as gold, which are to be recovered from the ore in a subsequent process stage, and possibly some impurity, such as arsenic In prior art methods, sulphide ore or the ore concentrate and a sulphur-binding lime-containing material are charged into a roasting furnace, the sulphide ore or the ore concentrate is roasted, with the emission of sulphur dioxide and heat, the roasting furnace is cooled by the injection of cooling water into it, the sulphur dioxide formed is reacted with the sulphur-binding lime-containing material to form calcium sulphate, and the formed calcium sulphate or calcium sulphite and the roasting material from the roasting process are discharged from the furnace.

The term "sulphide ore materials" as used in the present specification and claims includes sulphide ores, and sulphide ore concentrates. The term "precious metal" as used in the present specification and claims includes gold, copper, silver, and like metals found in sulphide ore materials.

The sulphide ore materials are typically fine-grained ore or sulphide ore concentrate dressed in some manner. The method according to the invention is well suited e.g. for processing auriferous pyritic ores, and in some cases also for copper ores, such as copper pyrite or other metal-sulphide-containing ores having relatively high sulphur contents and a recoverable amount of precious metals. Roasting is suitably effected in a roasting furnace with a fluidized bed. During roasting, the ores normally have a particle size of about 30–300 microns The sulphide ore materials often also contain as impurities arsenic, antimony or bismuth minerals. Considerable amounts of arsenides, for instance, may be present in the material to be treated, contents of up to 10–15% being not unusual The arsenic in the arsenides is oxidized in the same way as the sulphur in the sulphides. In roasting with an almost equivalent oxygen amount, volatile arsenic compounds, such as $As_2O_3$, are formed, which are generally expelled from the roasting furnace with the flue gases. The volatile arsenic compounds desublimate only at relatively low temperatures of about 100° C.

It is known that the sulphur content of flue gases from roasting furnaces as well as from combustion furnaces can be reduced by what is known as a dry process, by supplying solid calcium oxide to the furnace, or calcium carbonate or some other alkaline compound, such as dolomite, which reacts with the produced sulphur dioxide so as to form calcium sulphate, i.e. gypsum, or calcium sulphite.

U.S. Pat. No. 4,615,729 (the disclosure of which is hereby incorporated by reference herein) describes a two-stage method for sulphide copper concentrate. The copper concentrate is supplied to a roasting furnace together with dry limestone $CaCO_3$ or lime CaO as absorbent, and is roasted at temperatures above 850° C, i.e. above the temperature at which $CaCO_3$ is thermally decomposed to CaO. At this temperature the following reaction occurs:

$$CaCO_3 + SO_2 + + O_2 = CaSO_4 + CO_2$$

The sulphur is bound as calcium sulphate in the first roasting furnace. However, the furnace temperature should be maintained below 1000° C. because the calcium sulphate formed is decomposed at higher temperatures. The roasting material is passed from the first stage on to a second smelting stage where it is mixed with fresh copper concentrate. Pure oxygen is supplied to the furnace, resulting in the formation of lime-containing ferrite slag, pure copper, and gas rich in sulphur dioxide. This gas should then be treated or used, e.g. in a sulphuric acid plant, before it can be emitted into the atmosphere. The two-stage method described in U.S. Pat. No. 4,615,729 thus requires a separate plant for the recovery of sulphur dioxide.

In the roasting of sulphide ores for subsequent recovery of precious metals or other valuable metals, as in plants which are remote from other industries and in which the use of the sulphur dioxide of the off gases from roasting, for instance as sulphuric acid, is not desirable, the sulphur dioxide formed should be taken care of, for instance as gypsum, in connection with roasting.

The reaction between $SO_2$ and $CaCO_3$ during gas cleaning, as in conventional flue gas cleaning, involves a velocity-inhibiting factor because of the diffusion of gases both into and out of the reaction zone in a lime particle. This applies especially to roasting furnaces where the ore is roasted in a fluidized bed and where the lime is charged as relatively large particles. In such relatively large particles, the lime in the surface layer of the particles first reacts with the sulphur dioxide. On the particle surface a layer of calcium sulphate is then formed, preventing additional sulphur dioxide from penetrating into the particle to react with the unspent portion of lime in the particle. This results in long reaction times and a high consumption of absorbent when using limestone, for a reasonable degree of utilization of the lime. Although the use of burnt lime (CaO) ought to involve far more favorable conditions, the gypsum ($CaSO_4$) formed also has a reaction-inhibiting effect, so that an adequate degree of utilization of the burnt lime is not achieved. A sulphur absorption method where the flue gases are treated with calcium oxide or calcium carbonate which is charged as particles directly into the combustion or roasting furnace has thus been found to require a substantial excess of the lime-containing material for removing sulphur from the flue gases. Such excess lime is harmful in the following process stage.

Thus, when using lime, $CaCO_3$ or CaO, in connection with the roasting of sulphide materials, a fairly good elimination of $SO_2$ can be achieved only with a considerable excess of lime. Although, in most cases, this can be done without having a negative heat balance, both costs and consumption of material will increase.

If the material to be roasted should thereafter be subjected to leaching, which is often the case, for recovering valuable metals from the roasting material, a large excess of lime will have a cost-increasing effect on this process stage. When leaching gold or silver from the roasting material by cyanidation, a slight lime excess is of no major consequence, since leaching takes place in an alkaline environment, whereas when leaching e.g. copper, Cu, taking place in an acid environment, any excess of free lime means an equivalent consumption of acid.

To increase the reactivity of the limestone and the lime in sulphur absorption, different supplementary methods have been suggested.

Swedish Patent SE 451,158 suggests a method where the absorbent particles in a fluid bed furnace are disintegrated in the furnace by blowing gas at a high velocity into the fluidized bed through a special feeding nozzle. In this manner, particles in the bed are caused to collide with each other at a high velocity and are to some extent disintegrated, such that unspent absorbent present in the particle interior is exposed and can be used for absorbing sulphur dioxide from the flue gases.

Swedish Patent SE 457,014 describes another method for making the interior of absorbent particles available for absorption by withdrawing the particles from the furnace and treating them with water vapor. Calcium oxide and calcium carbonate in the material withdrawn then react with the water vapor, with the formation of calcium hydroxide. These reactions are sufficiently vigorous for splitting the particles. Unused absorption material in the particle interior is exposed and becomes available for absorption. The calcium hydroxide formed has, as a fine powder, high reactivity because of a large available reaction surface.

According to the present invention, a method is provided for roasting sulphide ores, in which sulphur dioxide formed during roasting can be easily and efficiently removed from the gases formed during roasting. The sulphur dioxide can be bound as a material which is solid and readily removed. The method of the invention is especially well suited for roasting precious-metal-bearing sulphide ores, and also can allow the recovery of arsenic, possibly released during roasting, as a compound which can be stably dumped.

By the present invention it has become possible, in a surprisingly simple manner, to solve the problems of sulphur dioxide absorption in the roasting methods described above, by mixing lime-containing material into the cooling water of the roasting furnace so as to supply a reactive lime slurry into the furnace. The lime slurry is e.g. a slurry of slaked lime or limestone, or e.g. a slurry of dolomite lime. Roasting is carried out under conditions promoting the formation of calcium sulphate, the sulphur being efficiently bound to the lime as calcium sulphate, or calcium sulphite (which already is present in the roasting furnace), and no additional sulphur-removing plant is required. The calcium sulphate or calcium sulphite can be withdrawn from the roasting furnace with the rest of the roasting material.

Thus, the roasting according to the present invention results, in the case of ordinary roasting, in binding $SO_2$ to $CaSO_4$ directly in the reactor. The reactor may be a regular roasting furnace, a reactor with a "bubbling"-type fluidized bed, or a circulating fluidized bed, or of a type therebetween. The process is usable when gypsum or calcium sulphite is formed and any existing free lime does not interfere with the following treatment. The process is of course especially useful when the $SO_2$ formed during roasting cannot be used in a sensible way for other purposes, or cannot be emitted into the atmosphere. Also in roasting plants close to ore deposits and remote from other industries, the sulphur should be removed from the flue gases even if it is not economical to reuse it as pure sulphur or sulphuric acid. The sulphur should then be stored in stable form. Calcium sulphate is such a stable form, suitable for dumping.

The roasting method according to the invention is conveniently used, e.g. on auriferous sulphides (pyrite and/or pyrrhotite) which cannot be leached with cyanide or other complexing agents, without oxidation. These deposits are usually quite small, and a plant for producing $H_2SO_4$ is too expensive and often there is no market for the acid. If such a deposit is located in the vicinity of residential or agricultural areas, it often remains unexploited because of the difficulty of making the ore suitable for gold leaching.

The roasting according to the present invention makes the roasting material leachable and offers a possibility of recovering valuable metals from the ore. The roasting material can then be subjected to cyanidation to recover the valuable metals As a result of the invention, it is possible to avoid large excessive amounts of unreacted lime in the roasting material, which would adversely affect the process.

The required amounts of lime are minimized, since the lime in aqueous slurry forms a highly reactive calcium hydroxide, and as an aqueous slurry it can easily be evenly distributed with the cooling water in the roasting furnace The amounts of cooling water are normally sufficient for the required amount of lime so that the lime slurry does not become too thick, which would give rise to clogging problems in the injection nozzles. The water evaporates in the roasting furnace and does not cause any waste water problems. The cooling water is preferably sprayed into the roasting furnace, e.g. through nozzles provided in the roof of the roasting furnace.

The present invention is applicable to roasting in different types of roasting furnaces, such as rotary furnaces, multi-stage ovens, fluid bed furnaces and also in fluid bed furnaces of the circulating-bed type.

The method according to the invention thus is well suited, e.g. for—roasting of auriferous pyritic ore with subsequent leaching with cyanide, and—roasting of copper ore with a first stage including cyanidation of precious metals, and subsequent stages including acid leaching of copper with subsequent recovery of metallic copper. Since the amounts of lime are minimized, both alkaline and acid leaching can be performed to recover precious metals, including copper.

In roasting and subsequent gold leaching, the roasting temperature should be selected so that no sintering of the particles occurs, but rather the roasting material becomes porous and easy to leach.

The roasting temperature for roasting sulphides for subsequent leaching should be below the lowest sintering temperature that may occur in the particle, but above the sulphating temperature of iron. To obtain as porous a material as possible, this means a suitable working range between about 600° C. and 850° C. Within this range, it would be almost impossible to use $CaCO_3$ also CaO would give an unsatisfactory yield. $Ca(OH)_2$, on the other hand, reacts much more completely than do both limestone and burnt lime. Since the roasting furnaces, under generally prevailing conditions, are normally cooled and controlled by direct water injection, the injection of lime slurry consisting of water and slaked lime can easily be brought about. This gives an active absorption material well distributed in the reaction chamber The water injection technique is generally known within the roasting technology, but no one has earlier demonstrated that it can be used for desulphurising gases formed during roasting.

In addition to being supplied with the cooling water, a supplementary amount of solid $Ca(OH)_2$ can be separately supplied to the furnace should the process so require. In the roasting of ores requiring such large amounts of lime that the cooling water slurry might have an excessively high content of lime if all the lime were supplied with the cooling water, part of the $Ca(OH)_2$ therefore be supplied as solid material.

The difference in the results obtained with prior-art roasting methods and the present invention can be expressed such that with CaO supplied to the bed there is achieved, under favorable conditions, a desulphurising efficiency of about 50% is achieved, whereas with $Ca(OH)_2$ a 90% desulphurising efficiency is achieved. This means that the use of CaO requires twice the theoretical amount of lime, while the use of $Ca(OH)_2$ requires only a 10% excess above the theoretical amount. The consequence of this, in terms of material and additional neutralization costs in the subsequent leaching, is easily appreciated.

Many of the auriferous sulphide ores that can be pretreated by roasting in many cases also contain significant amounts of arsenic. Roasting with excess air/oxygen, which is required for the formation of sulphate, also involves the formation or arsenate, preventing the arsenic from subliming as $As_2O_3$ and leaving the process with the flue gases. To obtain fast and readily reacting arsenates, the supply of CaO to the system is compulsory. By carrying out the roasting according to the invention, in the presence of reactive lime and with excess air, the arsenic will be bound in the form of calcium arsenates. At temperatures where iron sulphates are decomposed, the arsenic is also bound as iron arsenates. However, to obtain a more complete and faster reaction, the calcium salts are preferred.

The temperature in connection with roasting in a fluidized bed should advantageously be maintained in the range of about 600° C.-850° C., preferably within the range of about 650° C.-750° C. Complete oxidation of arsenic compounds into arsenates requires a temperature of about 600° C. to be efficient. Temperatures above 850° C. are however hazardous, since such high temperatures may give rise to sintering of the bed.

The calcium arsenates or iron arsenates formed are barely soluble. Since, in the roasting, all the CaO has not been converted to $CaSO_4$, a certain excess of Ca-ions will be present, which further reduces the solubility of the arsenates. Moreover, since Fe-ions are always available and since the Fe-arsenates have a lower solubility product than the Ca-arsenates, this will further reduce the soluble As-amount. A release of arsenate ions upon decomposition of the calcium arsenate by the formation of $CaCO_3$ owing to $CO_2$ present in the atmosphere is prevented, since there is always a sufficient amount of Fe-ions to form poorly soluble iron arsenate.

The vapor emanating from the cooling water during roasting is discharged directly with the flue gases. The heat in the flue gases may, if desired, be taken care of, e.g. in a common flue gas boiler.

EXAMPLE

The roasting of iron pyrite concentrate (38.6% Fe, 31.4% S, 30% gangue) requires, in normal roasting with 10% excess air, 1760 at standard cubic meter air per ton concentrate. When roasting with a bed temperature of 800° C., heat is released which, considering a 10% moisture content in the concentrate and the heat losses of the furnace, requires direct water injection of 400–450 kg $H_2O$/ton concentrate.

If the same roasting is performed at the same temperature, but with $Ca(OH)_2$ and with the formation of $CaSO_4$, a considerably larger amount of air is required, since all the $SO_2$ should be oxidized to sulfur trioxide and then form $CaSO_4$. This sulphating reaction releases a substantial amount of heat. This means that although the amount of air increases to 2400 $Nm^3$ air per ton concentrate (13% excess) and CaO is supplied in an amount of 610 kg per ton concentrate in the form of $Ca(OH)_2$, about 900 kg water per ton concentrate is still required to cool the reaction.

A process with 610 kg CaO added per ton concentrate thus required 900 kg water per ton concentrate. 610 kg CaO corresponds to 810 kg $Ca(OH)_2$, and the required amount of water is 700 kg. This gives a density value of 54%. Should considerably larger amounts of $Ca(OH)_2$ be required, e.g. for concentrates with unfavorable sulfur content/heat value ratios, additional solid $Ca(OH)_2$ can be supplied directly to the bed.

While the invention has been herein shown and described in what is presently conceived to be the most practical embodiment, it will be seen by those of ordinary skill in the art that many modifications may be made thereof within the scope of the invention, which scope is to be accorded the broadest interpretation of the appended claims so as to encompass all equivalent processes and methods.

What is claimed is:

1. A method of roasting sulphide ore materials containing precious metals and impurities using a furnace, the roasting resulting in the production of sulphur dioxide gas, comprising the steps of:

(a) feeding sulphide ore material containing precious metals and impurities into a furnace;

(b) roasting the sulphide ore material in the furnace at a roasting temperature of about 600–850° C. to produce a roasted material;

(c) mixing lime-containing material with water to produce an aqueous slurry;

(d) supplying the aqueous slurry to the furnace to cool the furnace and to effect reaction of sulphur dioxide gas with lime to form calcium sulphate;

(e) discharging calcium sulphate and/or sulphite from the furnace; and (f) discharging roasting material from the furnace, and acting on the roasted material to recover precious metal therefrom.

2. A method as recited in claim 1 wherein steps (c) and (d) are practiced by utilizing calcium hydroxide as the lime-containing material.

3. A method as recited in claim 2 wherein step (d) is practiced by spraying the aqueous slurry into the furnace.

4. A method as recited in claim 3 wherein the sulphide ore material contains arsenic as an impurity, and wherein steps (d) and (e) are practiced so as to cause the formation of stable calcium arsenates, which are discharged with the calcium sulphate and/or sulphite.

5. A method as recited in claim 4 wherein step (f) is practiced by acting on the roasted material with a cyanide containing material to recover gold, copper, or silver metal.

6. A method as recited in claim 3 wherein a first impurity in the sulphide ore material reacts with lime during the practice of step (d) to form stable calcium compounds containing the first impurity.

7. A method as recited in claim 6 wherein the first impurity is arsenic, and wherein the practice of step (d) results in the formation of calcium arsenate.

8. A method as recited in claim 3 wherein step (b) is practiced at a temperature of about 650-750° C.

9. A method as recited in claim 2 comprising the further step of supplying calcium hydroxide, in addition to that in the aqueous slurry, in solid form to the furnace, to react with sulphur dioxide gas.

10. A method as recited in claim 1 wherein step (b) is practiced at a temperature of about 650-750° C.

11. A method as recited in claim 1 wherein step (d) is practiced by spraying the aqueous slurry into the furnace.

12. A method as recited in claim 11 wherein the furnace has spray nozzles in the roof thereof, and wherein step (d) is practiced by introducing the aqueous slurry into the furnace through the nozzles.

13. A method as recited in claim 1 wherein the sulphide ore material contains arsenic as an impurity, and wherein steps (d) and (e) are practiced so as to cause the formation of stable calcium arsenates, which are discharged from the calcium sulphate and/or sulphite.

14. A method as recited in claim 1 wherein a first impurity in the sulphide ore material reacts with lime during the practice of step (d) to form stable calcium compounds containing the first impurity.

15. A method as recited in claim 1 comprising the further step of supplying lime containing material, in addition to that in the aqueous slurry, in solid form to the furnace, to react with sulphur dioxide gas.

16. A method as recited in claim 1 wherein the sulphide ore material comprises iron pyrite concentrate.

17. A method as recited in claim 1 wherein the furnace contains a fluidized bed, and wherein steps (a)-(d) are practiced continuously.

18. A method as recited in claim 17 wherein the sulphide ore material is in the form of particles having a particle size of about 30-300 microns.

19. A method as recited in claim 1 wherein step (f) is practiced by acting on the roasted material with a cyanide containing material to recover gold, copper, or silver metal.

20. A method as recited in claim 1 wherein step (c) is practiced by mixing with water a material selected from the group consisting essentially of slaked lime, limestone, and dolomite lime.

* * * * *